US007794287B1

(12) United States Patent
Harlan et al.

(10) Patent No.: US 7,794,287 B1
(45) Date of Patent: Sep. 14, 2010

(54) ELECTRICAL CONNECTOR CONFIGURED BY WAFER HAVING COUPLING FOIL AND METHOD FOR MAKING THE SAME

(75) Inventors: Tod M. Harlan, Mechanicsburgh, PA (US); Terrance F. Little, York, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/387,042

(22) Filed: Apr. 27, 2009

(51) Int. Cl.
*H01R 24/00* (2006.01)

(52) U.S. Cl. ..... 439/676; 439/941

(58) Field of Classification Search ..... 439/676, 439/607.01, 670.02, 941, 83, 620.01, 76.1, 439/541.5
See application file for complete search history.

(56) References Cited

U.S. PATENT DOCUMENTS 6,089,923 A * 7/2000 Phommachanh ..... 439/676
6,413,121 B1 7/2002 Hyland
6,447,341 B1 9/2002 Hyland
6,488,544 B1 12/2002 Hyland
6,506,080 B2 1/2003 Hyland
6,612,876 B2 9/2003 Hyland
6,612,877 B2 9/2003 Hyland
6,659,807 B1 * 12/2003 Zheng et al. ..... 439/676
6,863,575 B2 3/2005 Hyland

* cited by examiner

*Primary Examiner*—Javaid Nasri
(74) *Attorney, Agent, or Firm*—Ming Chieh Chang; Wei Te Chung; Andrew C. Cheng

(57) ABSTRACT

An electrical connector (100) includes an insulative housing (40) and a terminal module (10). The terminal module includes a dielectric wafer (2), a number of terminals (1) assembled within the dielectric wafer and a coupling foil (3) disposed on the dielectric wafer and having a plurality of circuit traces (31-34) extending along a first plane. Each terminal is formed with a joint (134-164). The circuit trace includes a body portion (312-342) aligned with a selected terminal of the number of terminals and a connection portion (311-341) fanning out from the body portion toward a specific terminal. The joint of the specific terminal comes to contact with the connection portion along a contact direction orthogonal to the first plane.

16 Claims, 7 Drawing Sheets

ELECTRICAL CONNECTOR CONFIGURED BY WAFER HAVING COUPLING FOIL AND METHOD FOR MAKING THE SAME

CROSS-REFERENCE TO RELATED APPLICATIONS

This patent application is related to a copending application Ser. No. 12/386,782, filed on Apr. 22, 2009, and entitled "Electrical Connector Configured By Wafer Having Coupling Lead Frame And Method For Making The Same", which is assigned to the same assignee with this application.

BACKGROUND OF THE INVENTION

1. Field of the Invention

The present invention relates to a RJ modular jack, and more particularly, to a RJ modular jack configured by a wafer on which coupling traces are provided so as to create electrical coupling between selected contact terminals disposed within the wafer.

2. Description of Related Art

To comply with a high speed trend of data transmission, electrical devices are required to have better performance. Performance requirements have significantly increased to a level identified by industry standards as Category 5. The Telecommunications Industry Association (TIA) in corporation with the Electronic Industries Association (EIA) has developed a proposed standard for Category 5 components. In such high speed applications, electrical coupling between adjacent terminals would create a great problem. Unless the electrical coupling between the terminals could be controlled effectively within the connector to an accepted level, it is highly unlikely that the connector can be used for long time.

U.S. Pat. No. 6,447,341 issued to James Hyland on Sep. 10, 2002 (hereinafter referred to as Hyland '341 patent) discloses an RJ modular connector comprises a housing and a terminal insert received in the housing. The terminal insert includes a pair of wafers, a plurality of conductive traces formed on an inner surface of the wafer, and a plurality of terminals sandwiched between the pair of wafers. One conductive trace of the plurality of traces has a body portion aligned with one selected terminal and a connection portion attached to another selected terminals thereby establishing electrical coupling between the two selected terminals by the trace.

Providing two wafers would increase the manufacturing cost of the connector and complicate the assembly of the connector. The terminals is attached to the connection portion of the trace for contacting with the trace, thus the electrical coupling among the terminals is unreliable.

Hence, an improved electrical connector is required to overcome the above-mentioned disadvantages of the related art.

SUMMARY OF THE INVENTION

A primary object of the present invention is to provide an electrical connector capable of achieving reliable electrical coupling among selected terminals with reduced cost.

To achieve the aforementioned object, an electrical connector includes an insulative housing and a terminal module retained in the insulative housing. The terminal module includes a dielectric wafer, a number of terminals assembled within the dielectric wafer and a coupling foil disposed on a surface of the dielectric wafer and having a plurality of circuit traces extending along a first plane. Each terminal is formed with a joint. The circuit trace includes a body portion aligned with a selected terminal of the number of terminals and a connection portion fanning out from the body portion toward a specific terminal of the number of terminals. The joint of the specific terminal comes into contact with the connection portion along a contact direction orthogonal to the first plane.

The electrical connection between the terminals and the circuit traces is reliably ensured due to the joint portion. The electrical coupling among the terminals is thereby reliably ensured. Only one dielectric wafer is needed rather than two wafers as referred in the '341 patent, would realize cost down.

Other objects, advantages and novel features of the invention will become more apparent from the following detailed description of a preferred embodiment when taken in conjunction with the accompanying drawings.

DETAILED DESCRIPTION OF THE INVENTION

Figure 1:
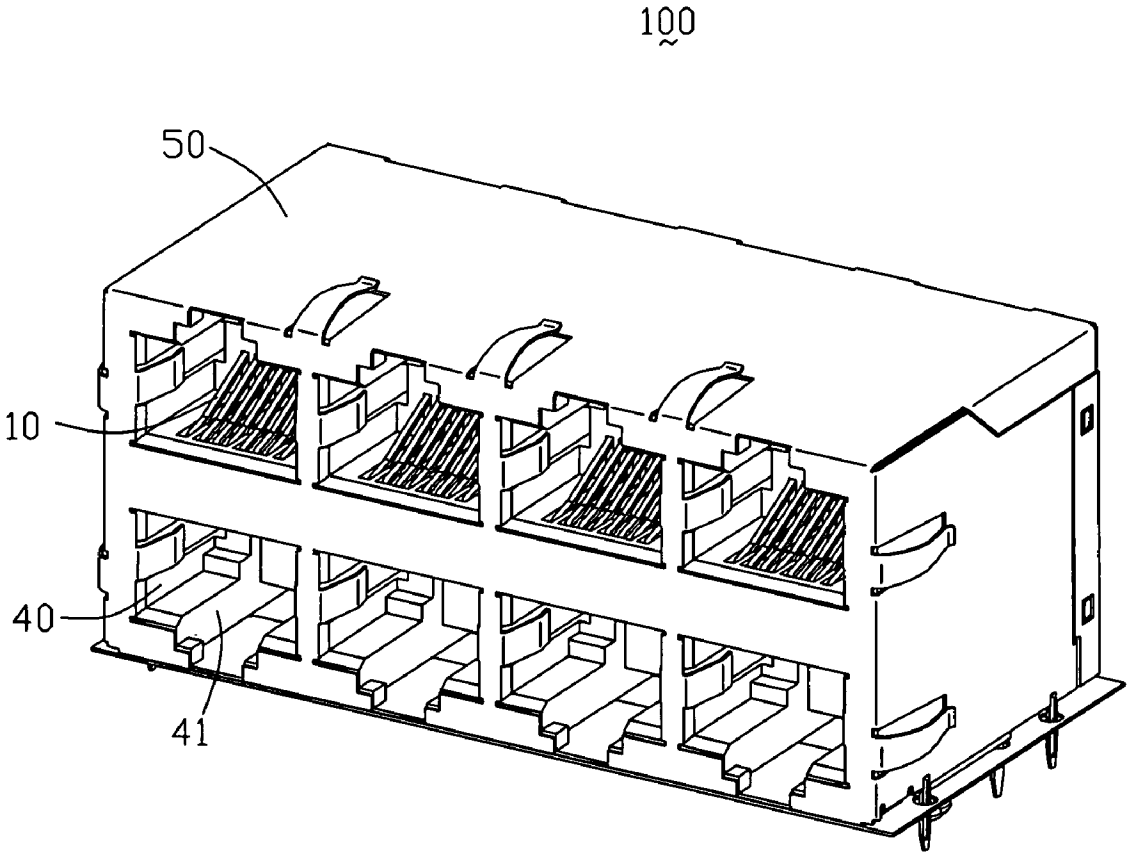
FIG. 1 is an assembled perspective view of an electrical connector in accordance with a first embodiment of the present invention.

Reference will now be made to the drawing figures to describe the present invention in detail. An electrical connector 100 in accordance with the preferred embodiment of the present invention comprises an insulative housing defining a cavity receiving a terminal module. In another embodiment as shown in FIG. 1, the insulative housing 40 defines a plurality of cavities 41 for receiving a plurality of terminal modules 10. The electrical connector 100 further has a shielding shell 50 attached to the insulative housing 40.

Figure 4:
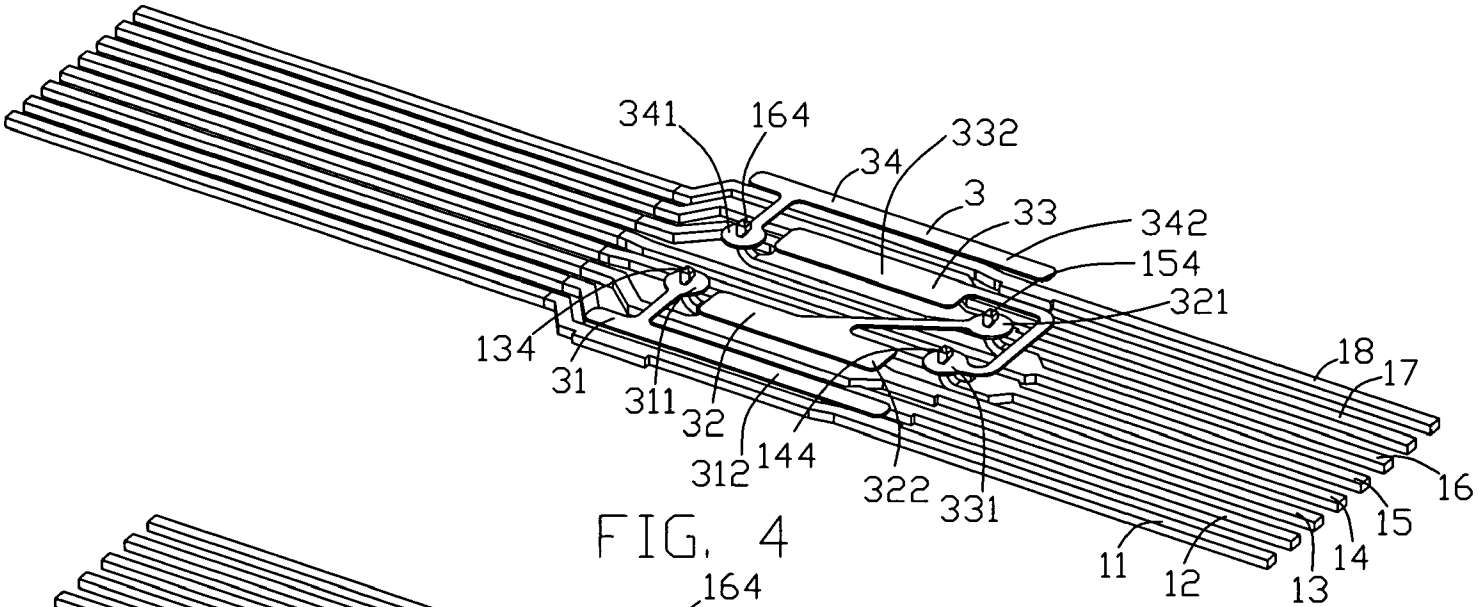
FIG. 4 is a perspective view showing a connection between the terminals and a coupling foil referred in the first embodiment.

Referring to FIG. 4, each terminal module 10 comprises a dielectric wafer 2, a plurality of terminals 1 and a coupling foil 3. The dielectric wafer 2 made in accordance with the present invention is configured by insert-molding the plurality of terminals 1, typically eight, altogether, i.e., first through eighth terminals 11-18. According to the certain application, electrical couplings are respectively and specially required between first and the third terminals 11 and 13, the third and fifth terminals 13 and 15, the fourth and sixth terminals 14 and 16, the sixth and eighth terminals 16 and 18.

Referring to FIG. 4, after the dielectric wafer 2 is molded with the eight terminals 11-18, and is formed with a flat upper surface. In order to create an electrical coupling between the first and third terminals 11 and 13, a first circuit trace 31 is provided and lying substantially over the first terminal 11 with its first body portion 312. The first circuit trace 31 includes a first connection portion 311 crossing on the upper surface in an area over the second terminal 12 and finally physically and electrically engaged with the third terminal 13. According to a preferred embodiment, a third joint 134 of the third terminal 13 penetrates upwardly through the first connection portion 311.

In order to create an electrical coupling between the third and fifth terminals 13 and 15, a second circuit trace 32 is provided and lying substantially over the third terminal 13 with its second body portion 322. The second circuit trace 32 includes a second connection portion 321 crossing on the upper surface in an area over the fourth terminal 14 and finally physically and electrically engaged with the fifth terminal 15. A fifth joint 154 of the fifth terminal 15 penetrates upwardly through the second connection portion 321.

In order to create an electrical coupling between the fourth and sixth terminals 14 and 16, a third circuit trace 33 is provided and lying substantially over the sixth terminal 16 with its third body portion 332. The third circuit trace 33 includes a third connection portion 331 crossing on the upper surface in an area over the fifth terminal 15 and finally physically and electrically engaged with the fourth terminal 14. A fourth joint 144 of the fourth terminal 14 penetrates upwardly through the third connection portion 331.

In order to create an electrical coupling between the sixth and eighth terminals 16 and 18, a fourth circuit trace 34 is provided and lying substantially over the seventh terminal 17 with its fourth body portion 342. The fourth circuit trace 34 includes a fourth connection portion 341 crossing on the upper surface in an area over the seventh terminal 17 and finally physically and electrically engaged with the seventh terminal 17. A sixth joint 164 of the sixth terminal 16 penetrates upwardly through the fourth connection portion 341.

Figure 2:
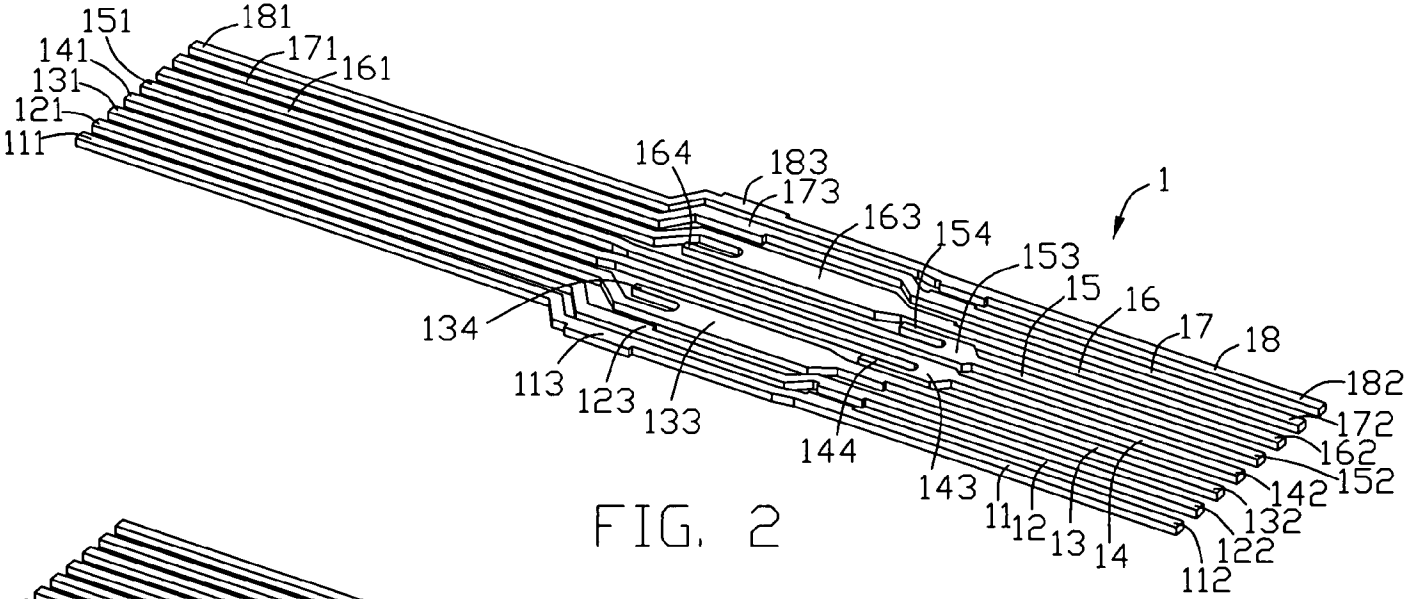
FIG. 2 is a perspective view showing a plurality of terminals referred in the first embodiment, when a terminal module has not been shaped.

Referring to FIG. 2, the plurality of terminals 1 are stamped with electrical coupling capacitive plates. The first through eighth terminals 11-18 are substantially parallel with each other and arranged in sequence, wherein the fifth through eighth terminals 15-18 are substantially symmetrical to the first through fourth terminals 11-14. Each of the first through eighth terminal 11-18 has a first through eighth primary end 111-181, a first through eighth tail end 112-182, and first through eighth intermediate portion 113-183 between the primary end 111-118 and the tail end 112-182. The first and eighth intermediate portions 113, 183 of the first and eighth terminals 11, 18 have same configurations. The second and seventh intermediate portions 123, 173 have same configurations and are bent toward the first and eighth intermediate portions 113, 183. The third and sixth intermediate portions 133, 163 also have same configurations and are respectively formed with a third and a sixth tip 134, 164. The fourth and fifth intermediate portions 143, 153 have same configurations and are respectively formed with a fourth and a fifth tip 144, 154.

Figure 3:
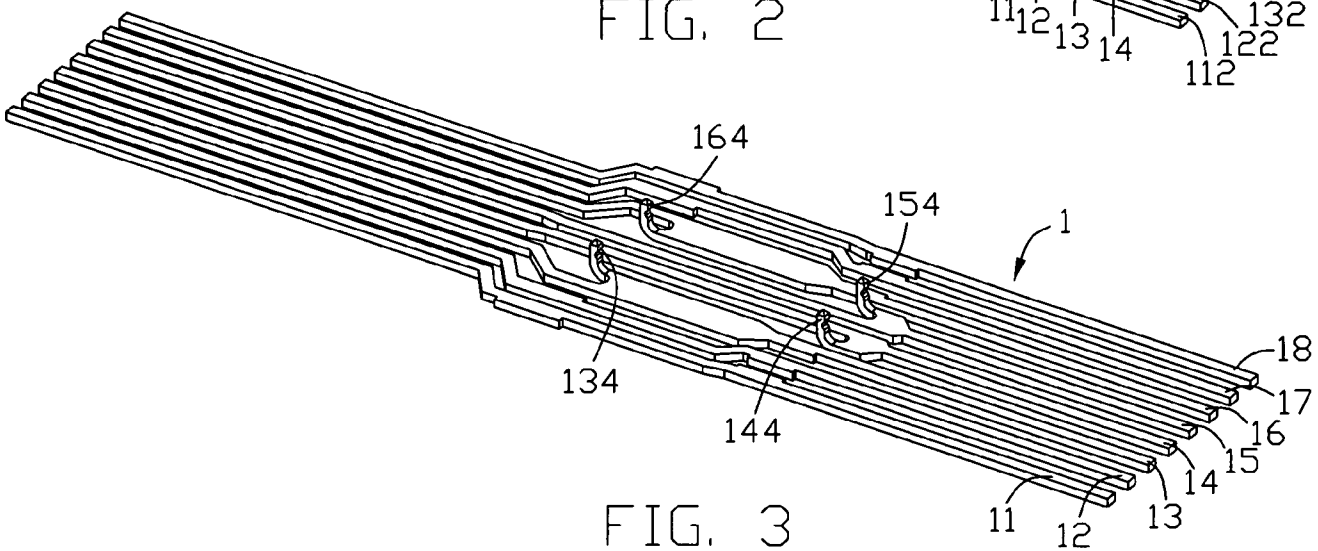
FIG. 3 is a perspective view showing the terminals formed with a plurality of joints, when the terminal module has not been shaped.

Referring to FIG. 3, the third through sixth tips 133-163 are formed up at a right angle prior to insert-molding to form themselves as third through sixth joints 134-164.

Figure 5:
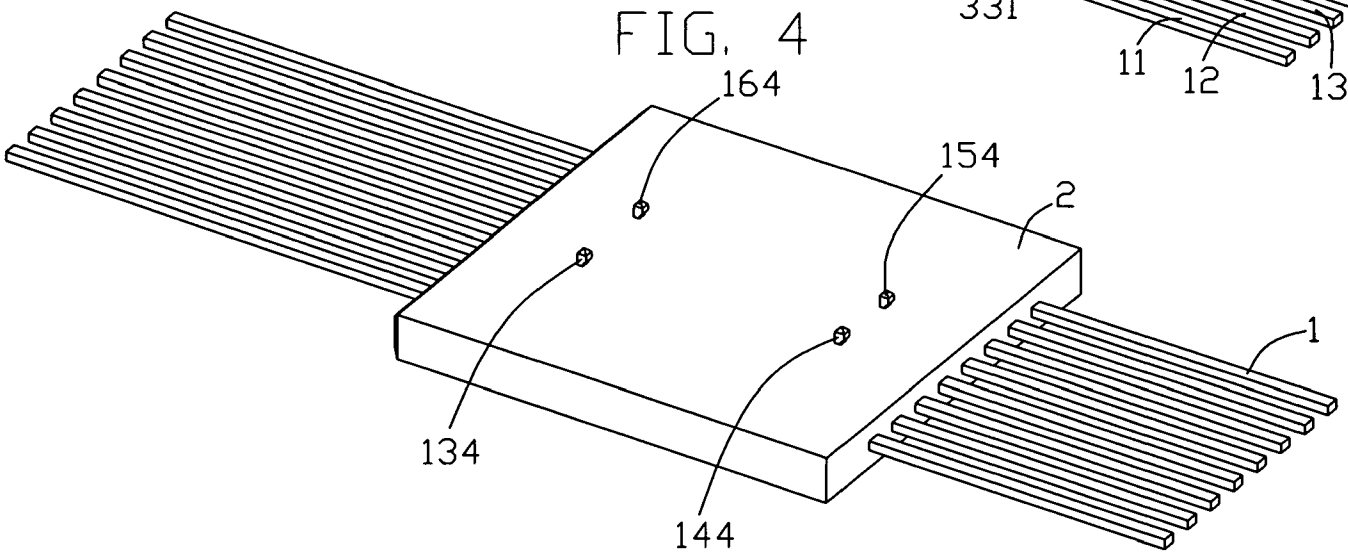
FIG. 5 is a perspective view showing the terminals insert molded within the dielectric wafer.
Figure 6:
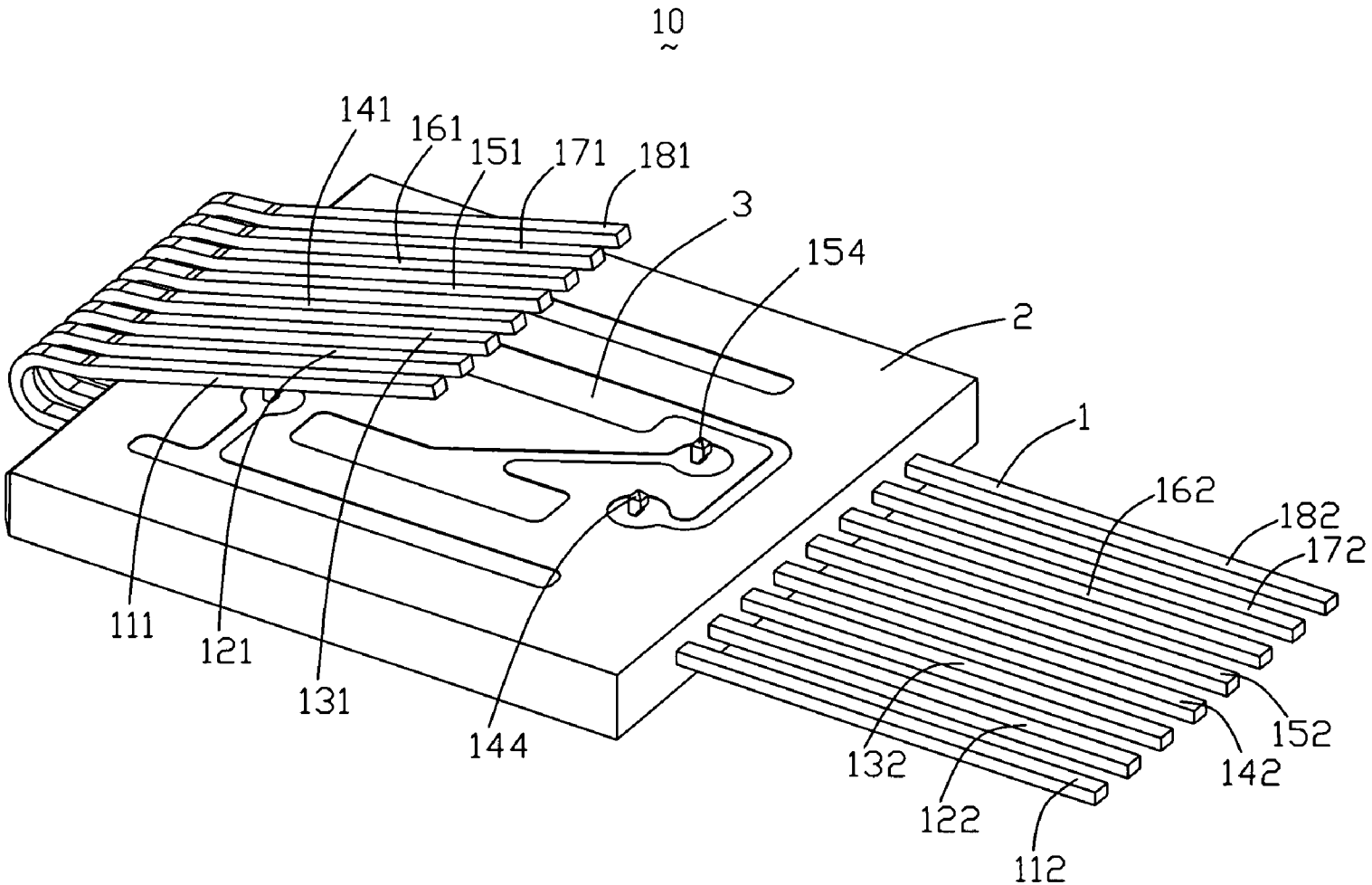
FIG. 6 is an assembled perspective view showing the terminal module referred in the first embodiment.

Referring to FIGS. 4-6, the terminal module 10 comprises a dielectric wafer 2 and a coupling foil 3 stamped and disposed directly onto a top surface of the dielectric wafer 2 after the terminals 1 are insert-molded in the dielectric wafer 2. The coupling foil 3 is made of thin metallic foil sheet. The coupling foil 3 has discrete pads stamped therein for connecting the coupling foil 3 with the terminals 1. As the stamping occurs, the soft nature of the dielectric wafer 2 will conform around the profile of the coupling foil 3 as it is pressed below the surface of the dielectric wafer 2. Thereby, the stamping will not come out of the dielectric wafer 2. Simultaneously, the pad area of the coupling foil 3 will pierce through the joints 134-164 from the coupling foil 3. Optionally, another method of attaching the coupling foil 3 to the dielectric wafer 2 is applying adhesive layer over the back of the surface of the coupling foil 3. When the foil 3 is pressed into the dielectric, the adhesive layer would firmly hold the coupling foil in place.

The first through fourth circuit traces 31-34 are provided in coplanar fashion arranged coplanarly. The first through fourth connection portions 311-341 respectively fan out from first through fourth body portions 312-342. The first and fourth body portions 312, 342 then extend along an outer side of the coupling foil 3 to define an imaginary region surrounded by the circuit traces 31-34. The first through fourth connection portions 311-341 are restricted within the region. The connection portions 311-341 would not occupy extra space outside the body portions 312-342.

The terminals 1 are insert molded within the dielectric wafer 2, with the third through sixth joints 134-164 protruding through the top surface of the dielectric wafer 2 for directly attaching to the coupling foil 3 (FIG. 5). Optionally, the terminals 1 could be assembled into the dielectric wafer 2 by other methods. It would be easy for assembling of the terminals 1. It is provided with necessary dielectric between the capacitive plates within the terminals 1.

The joints 134-164 could be formed over to provide a clinch connection to corresponding connection portions 311-341 of the circuit trace 31-34. Optionally, the joints 134-164 could be soldered to corresponding connection portions 311-341 of the circuit trace 31-34.

Referring to FIG. 6, the primary ends 111-118 of the first through eighth terminals 11-18 tilt upwardly to form as contact portions. The tail ends 112-182 are bent downwardly for soldering onto a circuit board (not shown).

Figure 7:
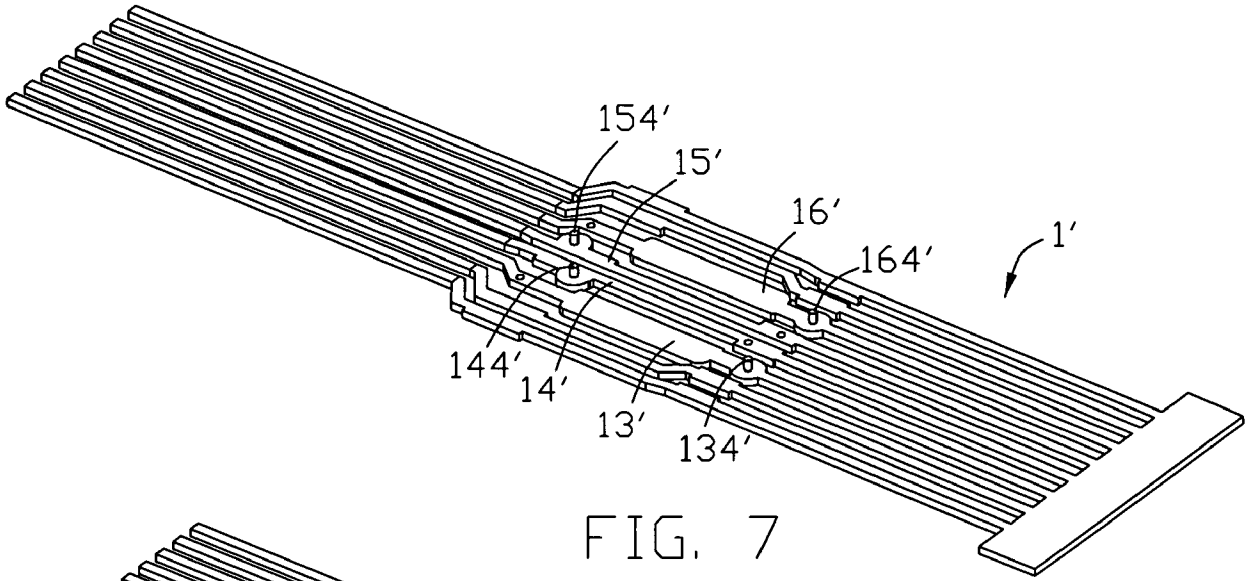
FIG. 7 is a perspective view similar to FIG. 3, in accordance with a second embodiment of the present invention.
Figure 8:
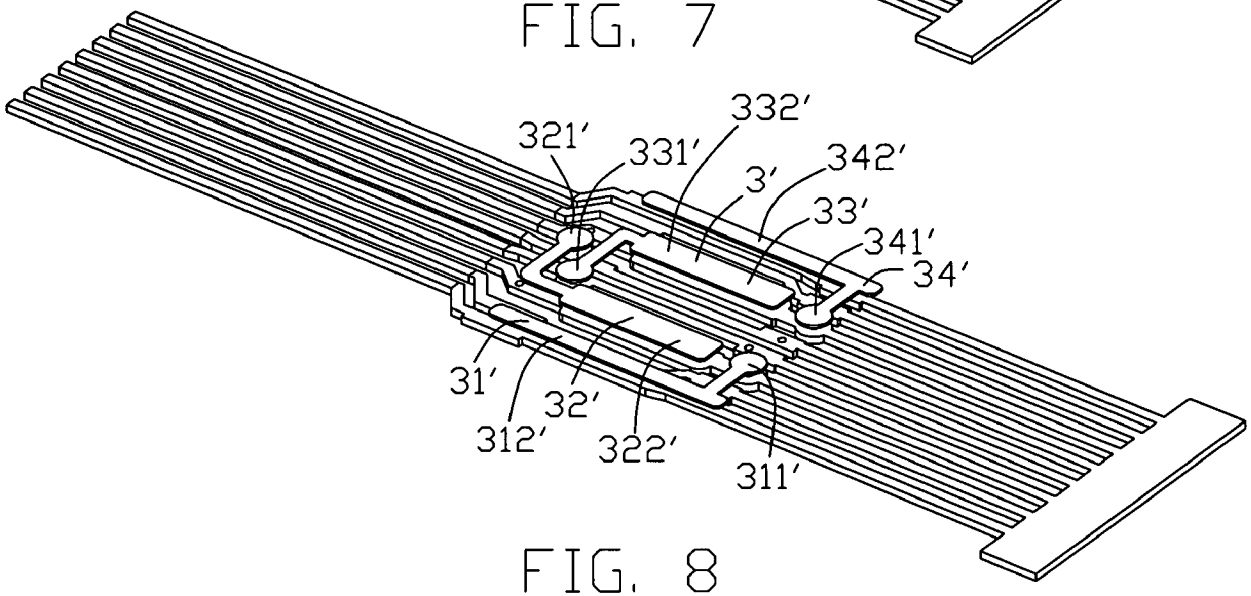
FIG. 8 is a perspective view similar to FIG. 4, in accordance with the second embodiment of the present invention.

FIGS. 7-10 show the terminal module 1 referred in a second embodiment. Referring to FIG. 7, the third through sixth terminals 13'-16' respectively have the third through sixth joints 134'-164' provided thereon. FIG. 8 shows the joints 134'-136' formed below the circuit traces 31'-34' and would not protrude through the circuit traces 31'-34'. The first through fourth circuit traces 31'-34' are respectively has a first through fourth body portion 312'-342' and a first through fourth connection portion 311'-341'. The connection portion 311'-341' extends from corresponding body portion 312'-342' toward a direction different from that of the connection portion 311-341 referred in the first embodiment. However, the connection portions 311'-341' are restricted within the region defined by the first and fourth body portions 312, 342.

Figure 9:
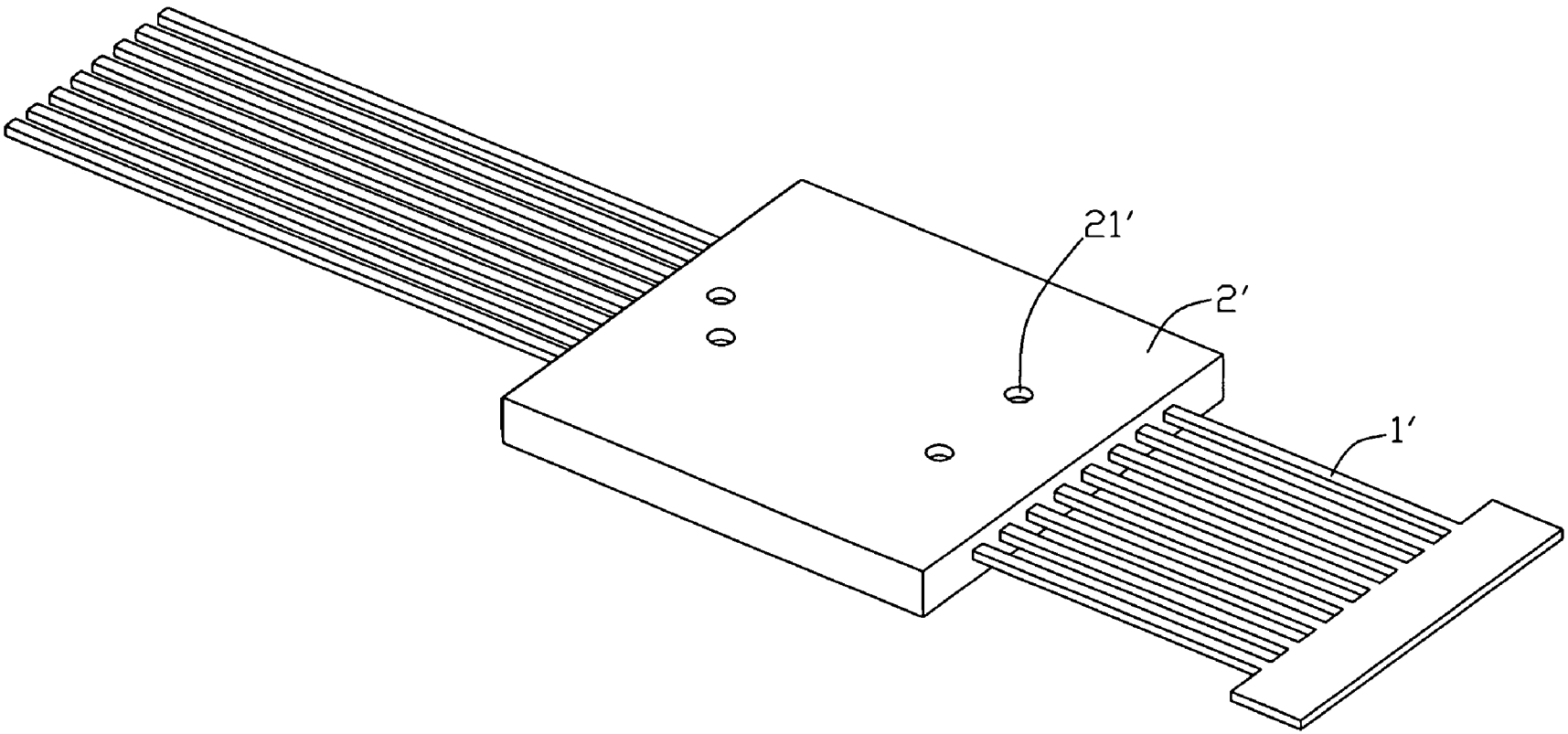
FIG. 9 is a perspective view similar to FIG. 5, in accordance with the second embodiment of the present invention.
Figure 10:
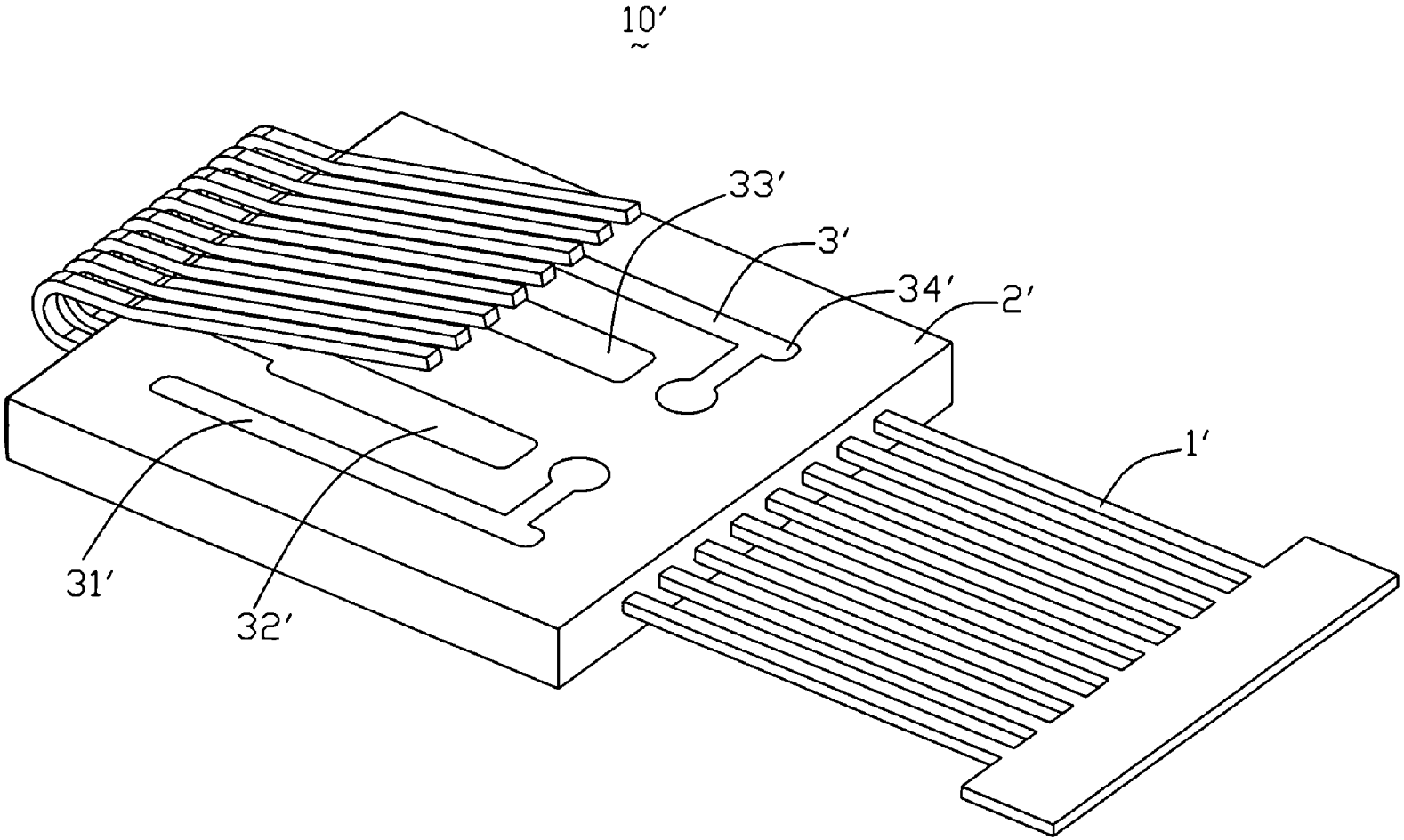
FIG. 10 is an assembled perspective view showing the terminal module referred in the second embodiment.

Referring to FIG. 9, the dielectric wafer 2' has a plurality of discrete molded holes 21' defined therein for providing access to discrete area of specific contact pads on the terminals 1' required for the coupling scheme. Solder paste may be applied through the discrete molded holes 21'. The coupling foil 3' is then stamped into the top surface of the dielectric wafer 2. Optionally, the dielectric wafer 2 is provided with a plurality of air pockets (not shown) for impedance control.

However, the disclosure is illustrative only, changes may be made in detail, especially in matter of shape, size, and arrangement of parts within the principles of the invention.

What is claimed is:

1. An electrical connector, comprising:

an insulative housing; and a terminal module retained in the insulative housing, the terminal module comprising:

a dielectric wafer;

a plurality of terminals assembled within the dielectric wafer, each terminal formed with a joint;

a coupling foil disposed on a surface of the dielectric wafer and having a plurality of circuit traces extending along a first plane thereon, each of said plurality of circuit traces comprising a body portion aligned with a selected terminal of the plurality of terminals and a connection portion radiating from the body portion toward a specific terminal of the plurality of terminals, said joint of the specific terminal coming to contact with said connection portion along a contact direction orthogonal to the first plane.

2. The electrical connector as claimed in claim 1, wherein said coupling foil is attached to the dielectric wafer by applying an adhesive layer over the back of the foil.

3. The electrical connector as claimed in claim 1, wherein said coupling foil is stamped and disposed onto the surface of the dielectric wafer after the terminals are insert molded in the dielectric wafer.

4. The electrical connector as claimed in claim 3, wherein said connection portions of the circuit traces are restricted within the region defined by the body portions of the circuit traces.

5. The electrical connector as claimed in claim 4, wherein said specific terminal has a tip formed up at a right angle to form itself as the joint, prior to insert molding the terminals within the dielectric wafer.

6. The electrical connector as claimed in claim 5, wherein said joint protrudes upwardly through the top surface of the dielectric wafer for attaching to the coupling foil, said joint providing a clinch connection to the connection portion of the circuit trace.

7. The electrical connector as claimed in claim 6, wherein said joint is soldered to the connection portion of the circuit trace.

8. The electrical connector as claimed in claim 4, wherein said joint is provided on the specific terminal and positioning between an upper surface of the specific terminal and a lower surface of the coupling foil.

9. The electrical connector as claimed in claim 8, wherein said dielectric wafer has a plurality of discrete molded holes defined therein for providing access to the joint of the specific terminal, after the terminals are insert molded in the dielectric wafer.

10. The electrical connector as claimed in claim 9, wherein said molded holes has solder paste provided therein for connecting the joint with the coupling foil.

11. The electrical connector as claimed in claim 1, wherein said plurality of terminals comprises a first through eighth terminals substantially parallel with each other and arranged in sequence.

12. The electrical connector as claimed in claim 11, wherein said selected terminal is the first terminal and the specific terminal is the third terminal.

13. The electrical connector as claimed in claim 11, wherein said selected terminal is the third terminal and the specific terminal is the fifth terminal.

14. The electrical connector as claimed in claim 11, wherein said selected terminal is the sixth terminal and the specific terminal is the fourth terminal.

15. The electrical connector as claimed in claim 11, wherein said selected terminal is the eighth terminal and the specific terminal is the sixth terminal.

16. The electrical connector as claimed in claim 1, further comprising a shielding shell attached to an outer surface of the insulative housing.

* * * * *